US009199499B2

(12) United States Patent
Derleth et al.

(10) Patent No.: US 9,199,499 B2
(45) Date of Patent: Dec. 1, 2015

(54) SYSTEM FOR DETECTING INOPERATIVE INKJETS IN THREE-DIMENSIONAL OBJECT PRINTING USING A CAMERA AND SUBSTRATE ROLL

(71) Applicant: Xerox Corporation, Norwalk, CT (US)

(72) Inventors: David S. Derleth, Webster, NY (US); Frank B. Tamarez Gomez, Webster, NY (US); Matthew D. Savoy, Webster, NY (US); Annie Liu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/231,218

(22) Filed: Mar. 31, 2014

(65) Prior Publication Data

US 2015/0273911 A1 Oct. 1, 2015

(51) Int. Cl.
*B41J 29/393* (2006.01)
*B41J 2/045* (2006.01)

(52) U.S. Cl.
CPC ..... *B41J 29/393* (2013.01); *B41J 2/04558* (2013.01)

(58) Field of Classification Search
CPC ..... B41J 29/393; B41J 2/045558
USPC ..... 347/19
See application file for complete search history.

(56) References Cited

U.S. PATENT DOCUMENTS

| | | | | |
|---|---|---|---|---|
| 6,361,139 | B1 * | 3/2002 | Gomez et al. | 347/19 |
| 2004/0012112 | A1 | 1/2004 | Davidson et al. | |
| 2004/0021724 | A1 * | 2/2004 | Kojima | 347/19 |
| 2006/0111807 | A1 | 5/2006 | Gothait et al. | |
| 2006/0141145 | A1 | 6/2006 | Davidson et al. | |
| 2009/0011066 | A1 | 1/2009 | Davidson et al. | |
| 2009/0231374 | A1 * | 9/2009 | Van de Wynckel et al. | 347/12 |
| 2010/0151136 | A1 | 6/2010 | Davidson et al. | |

FOREIGN PATENT DOCUMENTS

WO 03/026876 A2 4/2003

* cited by examiner

*Primary Examiner* — Stephen Meier
*Assistant Examiner* — Alexander D Shenderov
(74) *Attorney, Agent, or Firm* — Maginot Moore & Beck LLP

(57) ABSTRACT

An apparatus detects inoperative inkjets during printing of three-dimensional objects. The apparatus includes a roll of substrate that extends to a take up roller. A printhead prints a test pattern on a portion of the substrate pulled from the roll and the portion with the test pattern is moved opposite a digital camera. The digital camera generates data of the test pattern on the substrate and these data are analyzed to identify inoperative inkjets in the printhead.

15 Claims, 4 Drawing Sheets

SYSTEM FOR DETECTING INOPERATIVE INKJETS IN THREE-DIMENSIONAL OBJECT PRINTING USING A CAMERA AND SUBSTRATE ROLL

TECHNICAL FIELD

The device disclosed in this document relates to printers that produce three-dimensional objects and, more particularly, to accurate detection of inoperative inkjets in such printers.

BACKGROUND

Digital three-dimensional manufacturing, also known as digital additive manufacturing, is a process of making a three-dimensional solid object from a digital model of virtually any shape. Three-dimensional printing is an additive process in which one or more printheads eject successive layers of material on a substrate in different shapes. Three-dimensional printing is distinguishable from traditional object-forming techniques, which mostly rely on the removal of material from a work piece by a subtractive process, such as cutting or drilling.

The production of a three-dimensional object with these printers can require hours or, with some objects, even days. One issue that arises in the production of three-dimensional objects with a three-dimensional printer is consistent functionality of the inkjets in the printheads that eject the drops of material that form the objects. During printing of an object, one or more inkjets can deteriorate by ejecting the material at an angle, rather than normal, to the printhead, ejecting drops that are smaller than an inkjet should eject, or by failing to eject any drop at all. An inkjet suffering from any of these operational deficiencies is known as an inoperative inkjet. If the operational status of one or more inkjets deteriorates during object printing, the quality of the printed object cannot be assessed until the printing operation is completed. Consequently, print jobs requiring many hours or multiple days can produce objects that do not conform to specifications due to inoperative inkjets in the printheads. Once such objects are detected, the printed objects are scrapped, restorative procedures are applied to the printheads to restore inkjet functionality, and the print job is repeated. An apparatus that enables detection of inoperative inkjets while printing would enable restorative procedures to be applied during object printing so a properly formed object could be produced. In this manner, product yield for the printer is improved and its printing is more efficient. The apparatus should be able to detect inoperative inkjets that eject a multitude of printing materials, such as clear, colored, translucent, phosphorescent, and waxy materials.

SUMMARY

An apparatus that enables inoperative inkjet detection in three-dimensional printers includes a supply of substrate configured to move a substrate to a position to receive drops ejected from a printhead, a digital camera configured to generate data corresponding to a test pattern formed by the drops received on the substrate, and a controller operatively connected to the supply of substrate and the digital camera, the controller being configured to move the substrate to a second position opposite the digital camera after the test pattern has been formed on the substrate while the substrate remains stationary at a first position, to operate the digital camera to generate data of the test pattern on the substrate, and to identify inoperable inkjets in the printhead with reference to the data received from the digital camera.

A printer that incorporates the apparatus for detecting inoperative inkjets includes a printhead configured with inkjets to eject drops of material, a supply of substrate configured to move a substrate to a position opposite the printhead to receive drops ejected from the printhead, a digital camera configured to generate data corresponding to the drops on the substrate, and a controller operatively connected to the supply of substrate, the digital camera, and the printhead, the controller being configured to operate the printhead to eject a predetermined number of drops of material from each inkjet in the printhead onto the substrate while the substrate remains stationary at the position opposite the printhead to enable the predetermined number of drops of material to form a test pattern on the substrate, to move the substrate from being opposite the printhead to a position opposite the digital camera, to operate the digital camera to generate data of the test pattern on the substrate, and to identify inoperable inkjets in the printhead with reference to the data received from the digital camera.

BRIEF DESCRIPTION OF THE DRAWINGS

The foregoing aspects and other features of an apparatus or printer that detects inoperative inkjets during three-dimensional printing are explained in the following description, taken in connection with the accompanying drawings.

DETAILED DESCRIPTION

Figure 1:
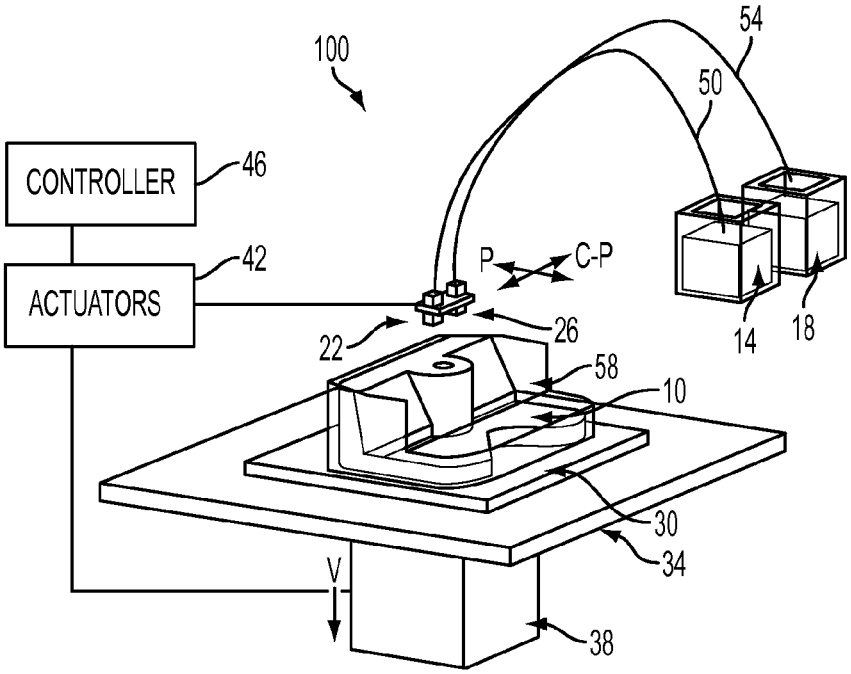
FIG. 1 is a perspective view of a three-dimensional object printer.

For a general understanding of the environment for the device disclosed herein as well as the details for the device, reference is made to the drawings. In the drawings, like reference numerals designate like elements.

FIG. 1 shows a configuration of components in a printer 100, which produces a three-dimensional object or part 10. As used in this document, the term "three-dimensional printer" refers to any device that ejects material with reference to image data of an object to form a three-dimensional object. The printer 100 includes a support material reservoir 14, a build material reservoir 18, a pair of inkjet printheads 22, 26, a build substrate 30, a planar support member 34, a columnar support member 38, an actuator 42, and a controller 46. Conduit 50 connects printhead 22 to support material reservoir 14 and conduit 54 connects printhead 26 to build material reservoir 18. Both inkjet printheads are operated by the controller 46 with reference to three-dimensional image data in a memory operatively connected to the controller to eject the support and build materials supplied to each respective printhead. The build material forms the structure of the part 10 being produced, while the support structure 58 formed by the support material enables the building material to maintain its shape while the material solidifies as the part is being constructed. After the part is finished, the support structure 58 is removed by washing, blowing, or melting.

The controller 46 is also operatively connected to at least one and possibly more actuators 42 to control movement of the planar support member 34, the columnar support member 38, and the printheads 22, 26 relative to one another. That is, one or more actuators can be operatively connected to structure supporting the printheads to move the printheads in a process direction and a cross-process direction with reference to the surface of the planar support member. Alternatively, one or more actuators can be operatively connected to the planar support member 34 to move the surface on which the part is being produced in the process and cross-process directions in the plane of the planar support member 34. As used herein, the term "process direction" refers to movement along one axis in the surface of the planar support member 34 and "cross-process direction" refers to movement along an axis in the planar support member surface that is orthogonal to the process direction axis in that surface. These directions are denoted with the letters "P" and "C-P" in FIG. 1. The printheads 22, 26 and the columnar support member 38 also move in a direction that is orthogonal to the planar support member 34. This direction is called the vertical direction in this document, is parallel to the columnar support member 38, and is denoted with the letter "V" in FIG. 1. Movement in the vertical direction is achieved with one or more actuators operatively connected to the columnar member 38, by one or more actuators operatively connected to the printheads 22, 26, or by one or more actuators operatively connected to both the columnar support member 38 and the printheads 22, 26. These actuators in these various configurations are operatively connected to the controller 46, which operates the actuators to move the columnar member 38, the printheads 22, 26, or both in the vertical direction.

Figure 2:
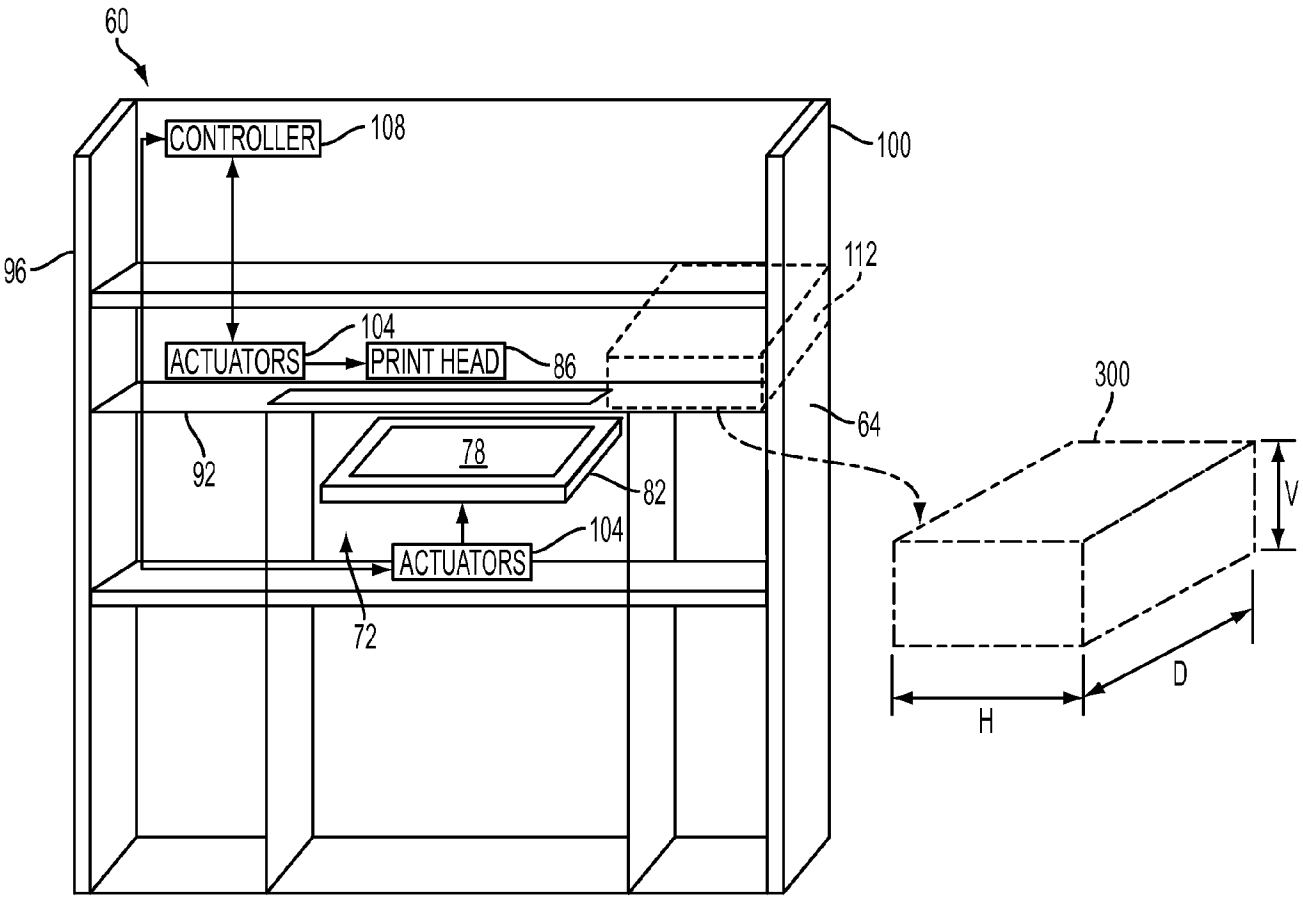
FIG. 2 is front view of a three-dimensional object printer having a housing that depicts a space within the housing for a module that enables inoperative inkjets in the printhead to be detected during a printing operation.

A three-dimensional object printer having a housing is shown in FIG. 2. That printer 60 has a housing 64. Within the housing 64 are six compartments that are generally cubic in shape. The housing 64 is shown in FIG. 2 without the doors that close to conceal the compartments. Compartment 72 includes a planar support 78 on a movable platform 82. Movable platform 82 is configured with one or more actuators and guide members (not shown) to enable the movable platform 82 to move up and down in a vertical direction. The planar support 78 is the surface on which a three-dimensional object is formed. In some embodiments, the printhead 86 has a length that is approximately equal to the length of the planar support 78 in the direction from the back wall of compartment 72 to the opening at the front of the compartment. In these embodiments, printhead 86 is mounted on support member 92 in the space between sidewalls 96 and 100 of housing 64 for linear reciprocating movement only. In other embodiments, the printhead 86 has a length that is less than the length of the planar support 78 in the direction from the back wall of compartment 72 to the opening at the front of the compartment. In these embodiments, printhead 86 is mounted on support member 92 in the space between sidewalls 96 and 100 of housing 64 for reciprocating movement in two orthogonal directions in a plane above compartment 72. In these various embodiments, one or more actuators 104 are operatively connected to the printhead 86. Controller 108 operates the actuators 104 to move the printhead 86 either linearly back and forth on support member 92 or to move the printhead in two orthogonal directions within a plane. By selectively operating the inkjets in the printhead 86 and vertically moving the support platform 82 and horizontally moving the printhead 86 on the member 92, a three-dimensional object can be formed on the planar support 78.

The area 112 outlined in dashes in FIG. 2 identifies the placement of a module that uses a camera to detect inoperative inkjets in the printer 60. As noted above, if an inkjet fails during printing of an object by either completely or partially failing to eject material or by errantly ejecting material in a skewed direction, the object being produced is malformed. Currently, this malformation cannot be detected until production of the object is finished. By using area 112 to house a camera that generates image data of a test pattern on a substrate, printer 60 can be configured to detect inoperative inkjets during object production as described more fully below. Some components within the module 300 can move in the horizontal direction H, depth direction D, and vertical direction V as shown in the figure.

Figure 3:
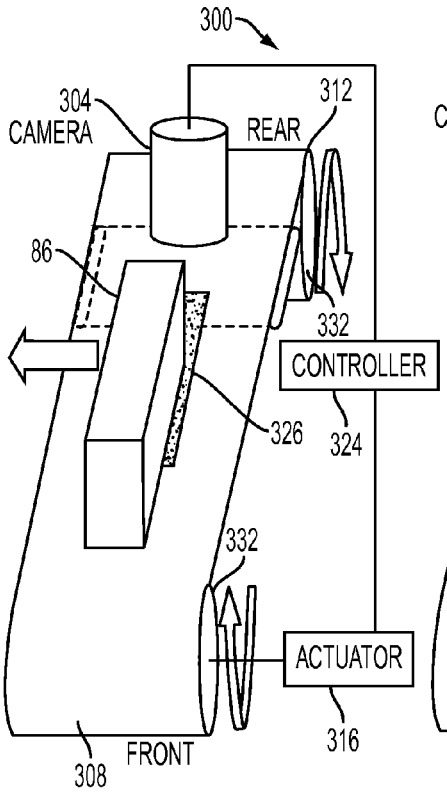
FIG. 3 is a perspective view of a printhead moving out of a module for detecting inoperative inkjets that fits in the space 112 shown in FIG. 2 after the printhead has printed a test pattern.

One embodiment of a module that detects inoperative inkjets ejecting materials, some of which may be clear, during object printing is shown in the block diagram of FIG. 3. The module 300 is configured to fit within area 112 of printer 60. The module 300 includes a digital camera 304, a supply roll of substrate 308, a take up roll 312, one or more actuators 316, and a controller 324. Controller 324 is configured to move the camera 304 bi-directionally across the width of the substrate pulled from the supply 308 as shown in the figure. The controller 324 is also operatively connected to one of the actuators 316 to drive at least one of the rollers 332 to pull substrate from the supply roll 308 and wind the substrate on take up roll 312. The substrate pulled from supply roll 308 forms a planar member made of a material that supports the build material and the support material ejected from the printhead 86 and that contrasts with the building material and support material. In one embodiment, the digital camera 304 is a Unitron AU-500-MADM camera available from Unitron of Commack, N.Y. This camera is an autofocusing 5 megapixel camera that can take up to 15 frames per second. It includes white light LEDs to illuminate the field of view and has automatic white balance/exposure/gain.

Figure 5:
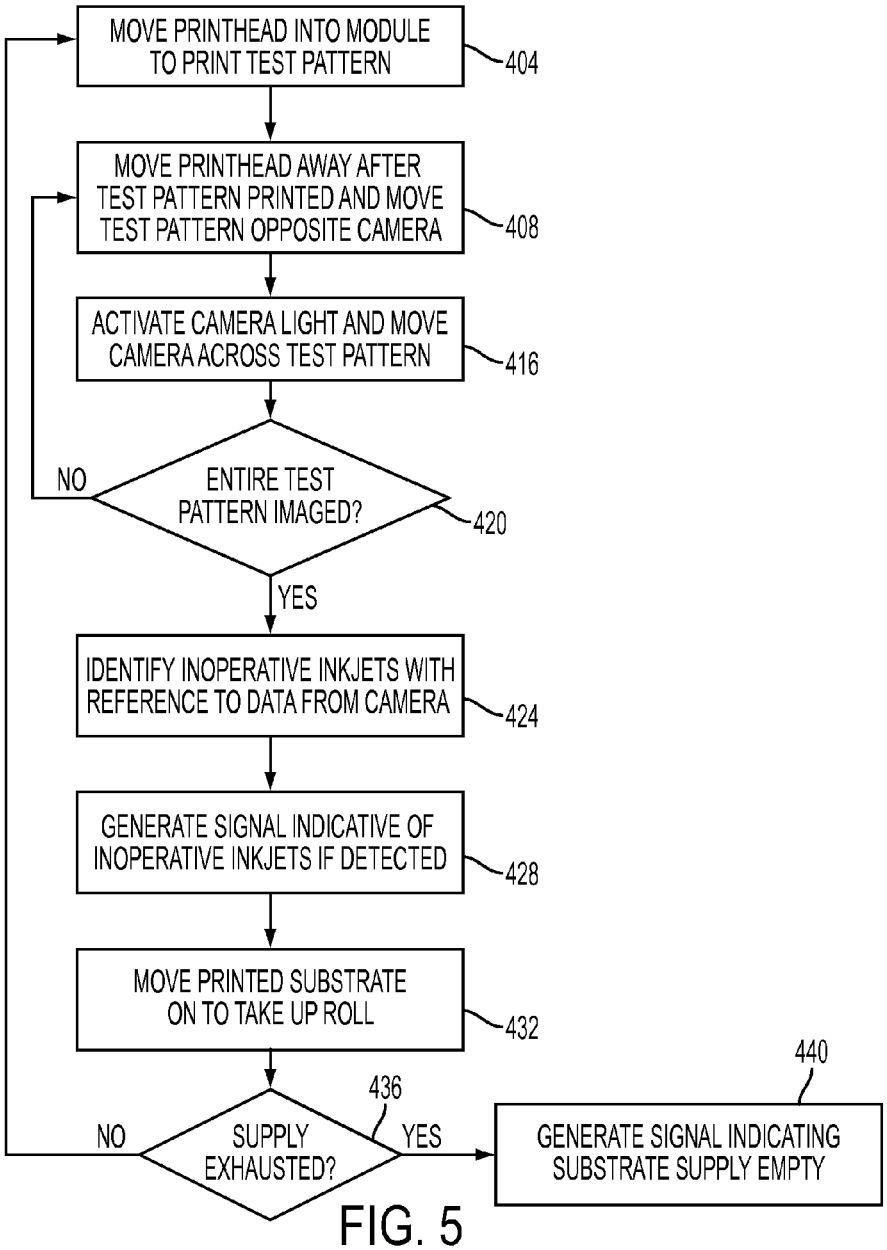
FIG. 5 is a flow diagram of a method for operating the module of FIG. 3.

A method of operating a printer that produces three-dimensional objects is shown in FIG. 5. In the description of this method, statements that a process is performing some task or function refers to a controller or general purpose processor executing programmed instructions stored in a memory operatively connected to the controller or processor to manipulate data or to operate one or more components in the printer to perform the task or function. The controller 324 noted above can be such a controller or processor. Alternatively, the controller 324 can be implemented with more than one processor and associated circuitry and components, each of which is configured to form one or more tasks or functions described herein.

Figure 4:
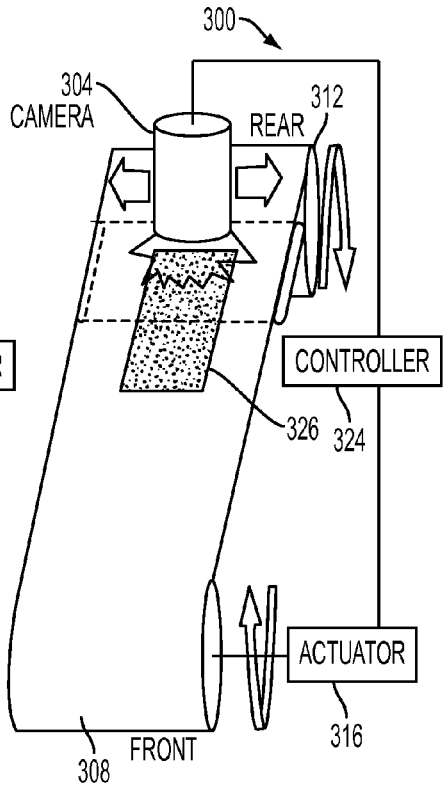
FIG. 4 is a perspective view of the module of FIG. 3 in which a camera generates image data of the test pattern printed on the substrate.

At predetermined times in the printing operation, the controller 108 (FIG. 2) operates an actuator 104 to move the printhead 86 into the module 300 located in the area 112 where controller 108 operates the printhead 86 to eject build and support material onto the substrate 308, which is stationary while printhead 86 is depositing build and support material (block 404). In one embodiment, each inkjet in the printhead is repetitively operated to form drops of material, also called a test dot, on a portion of the substrate 308 opposite the inkjet. After the test pattern 326 is printed, controller 108 moves the printhead 86 out of the module 300 as shown in FIG. 3 and generates a signal for controller 324, which operates the actuator(s) 316 to drive a portion of the substrate that has been printed with the test pattern within the field of view of the camera 304 (block 408). The controller then activates the light source in the camera and moves the camera across the substrate to generate image data of a portion of the test pattern on the substrate (block 416). The controller checks to see if the entire test pattern has been imaged (block 420) and, if not, advances the printed portion of the substrate and moves the camera across the substrate to image strips of the printed test pattern until all of the test pattern area has been imaged (blocks 408 and 416). This operation of moving the test pattern and the camera to image the entire test pattern is shown in FIG. 4. Once the entire test pattern has been imaged, the image data generated by the camera are analyzed with reference to expected positions for the build and support material used to form the test pattern to identify inoperative inkjets (block 424). If inoperative inkjets are identified, a signal indicative of the defective printhead is generated for the operator of the printer (block 428). The operator can then take appropriate action. The controller 324 continues to operate the actuator 316 to rotate the printed portion of the substrate onto the take up roll 312 (block 432). The controller checks for exhaustion of the supply roll 308 (block 436) and generates a signal indicative of the supply roll 308 needing replenishment if exhaustion is detected (block 440). An operator can then remove the take up roll 312 and install a new supply roll 308 and a new take up roll 312. Otherwise, the process is ready to repeat when the printhead returns to the module for another printhead test.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A printer comprising:

a printhead configured with inkjets to eject drops of material;

a supply of substrate configured to move a substrate to a position opposite the printhead to receive drops ejected from the printhead;

a digital camera configured to generate data corresponding to the drops on the substrate; and a controller operatively connected to the supply of substrate, the digital camera, and the printhead, the controller being configured to operate each inkjet in the printhead repetitively to eject a predetermined number of drops of material, which is greater than one, from each inkjet in the printhead onto the substrate while the substrate remains stationary at the position opposite the printhead to enable the predetermined number of drops of material to form a test dot for each inkjet having the predetermined number of drops of material at a position opposite each inkjet so the test dots form a test pattern on the substrate, to move the substrate from being opposite the printhead to a position opposite the digital camera, to operate the digital camera to generate data of the test pattern on the substrate, and to identify inoperable inkjets in the printhead with reference to the data received from the digital camera.

2. The printer of claim 1 further comprising:

a take up roll operatively connected to the supply of substrate; and the controller is further configured to rotate at least one of the supply of substrate and the take up roll to move a portion of the substrate from the supply opposite the printhead for the ejection of the drops and to move the portion of the substrate opposite the digital camera.

3. The printer of claim 2, the controller being further configured to generate a signal indicative of the supply of substrate being exhausted.

4. The printer of claim 2, the controller being further configured to rotate the at least one of the supply of substrate and the take up roll and to move the digital camera across a width of the substrate to generate data of the test pattern on the substrate.

5. The printer of claim 4, the controller being further configured to generate data of strips of the test pattern by rotating the at least one of the supply of substrate and the take up roll and moving the digital camera across a width of the substrate until data for the entire test pattern on the substrate is generated.

6. The printer of claim 1, the controller being further configured to move the digital camera across a width of the substrate.

7. The printer of claim 6, the controller being further configured to move the digital camera across the width of the substrate bi-directionally.

8. The printer of claim 1, the camera further comprising:

a source of white light oriented to illuminate a field of view of the camera; and the controller is further configured to activate the source of white light for the digital camera.

9. An appartus comprising:

a supply of substrate configured to move a substrate to a position to receive drops ejected from a printhead;

a digital camera configured to generate data corresponding to a test pattern formed by the drops received on the substrate, the digital camera including a source of white light oriented to illuminate a field of view of the camera; and a controller operatively connected to the supply of substrate and the digital camera, the controller being configured to move the substrate to a second position opposite the digital camera after the test pattern has been formed on the substrate while the substrate remains stationary at a first position, to activate the source of white light to illuminate the field of view of the digital camera, to operate the digital camera to generate data of the test pattern on the substrate, and to identify inoperable inkjets in the printhead with reference to the data received from the digital camera.

10. The apparatus of claim 9 further comprising:

a take up roll operatively connected to the supply of substrate; and the controller is further configured to rotate at least one of the supply of substrate and the take up roll to move a portion of the substrate from the supply to the first position and to move the portion of the substrate to the second position.

11. The apparatus of claim 10, the controller being further configured to generate a signal indicative of the supply of substrate being exhausted.

12. The apparatus of claim 10, the controller being further configured to rotate the at least one of the supply of substrate and the take up roll and to move the digital camera across a width of the substrate to generate data of the test pattern on the substrate.

13. The apparatus of claim 12, the controller being further configured to generate data of strips of the test pattern by rotating the at least one of the supply of substrate and the take up roll and moving the digital camera across a width of the substrate until data for the entire test pattern on the substrate is generated.

14. The apparatus of claim 9, the controller being further configured to move the digital camera across a width of the substrate.

15. The apparatus of claim 14, the controller being further configured to move the digital camera across the width of the substrate bi-directionally.

* * * * *